US009706886B2

(12) United States Patent
Pierson

(10) Patent No.: US 9,706,886 B2
(45) Date of Patent: Jul. 18, 2017

(54) RECLOSABLE LID ASSEMBLY FOR COVERING DISPENSING OPENING OF FLEXIBLE PACKAGING FOR WET WIPES

(71) Applicant: PIERSON INDUSTRIES, INC., Rockaway, NJ (US)

(72) Inventor: Theodore J. Pierson, Kinnelon, NJ (US)

(73) Assignee: PIERSON INDUSTRIES, INC., Rockaway, NJ (US)

( * ) Notice: Subject to any disclaimer, the term of this patent is extended or adjusted under 35 U.S.C. 154(b) by 0 days.

(21) Appl. No.: 14/677,240

(22) Filed: Apr. 2, 2015

(65) Prior Publication Data

US 2015/0282681 A1 Oct. 8, 2015

Related U.S. Application Data

(60) Provisional application No. 61/975,211, filed on Apr. 4, 2014.

(51) Int. Cl.

| | |
|---|---|
| ***A47K 10/42*** | (2006.01) |
| ***B65D 75/58*** | (2006.01) |
| *A47K 10/32* | (2006.01) |

(52) U.S. Cl.

CPC ..... *A47K 10/421* (2013.01); *B65D 75/5827* (2013.01); *B65D 75/5877* (2013.01); *A47K 2010/3266* (2013.01)

(58) Field of Classification Search

CPC ..... A47K 10/421; A47K 2010/3266; B65D 43/0277; B65D 43/0237; B65D 43/0264; B65D 43/0235; B65D 43/0283; B65D 43/0281; B65D 43/0279; B65D 2251/0081; B65D 2251/0021; B65D 2251/0018; B65D 2251/1016; B65D 2251/1058; B65D 2251/1083; B65D 2251/105; B65D 55/02

See application file for complete search history.

(56) References Cited

U.S. PATENT DOCUMENTS

| | | | | |
|---|---|---|---|---|
| 4,658,980 A * | 4/1987 | Lindstrom | B65D 47/0842 | 220/214 |
| 5,052,572 A * | 10/1991 | Pherigo | B65D 43/169 | 220/266 |
| 5,219,087 A * | 6/1993 | Christensson | B65D 55/06 | 220/266 |
| 6,715,632 B2 * | 4/2004 | Baker | B65D 43/22 | 220/4.23 |

(Continued)

*Primary Examiner* — Anthony Stashick
*Assistant Examiner* — James Way
(74) *Attorney, Agent, or Firm* — Abelman, Frayne & Schwab

(57) ABSTRACT

According to the principles of the present invention a reclosable lid assembly is provided. The assembly is intended for covering a dispensing opening of flexible packaging for wet wipes. The assembly includes a main lid secured to the assembly and positioned above the dispensing opening. The assembly includes a break tab secured to the assembly by at least one breakable connector. In an initial position, the break tab covers part of the main lid to prevent the main lid from being opened by a user. A functioning position is achieved when the user applies a force to the break tab to break the breakable connector for allowing the break tab to be moved away from the main lid so that the main lid can be freely opened by a user.

18 Claims, 12 Drawing Sheets

(56) References Cited

U.S. PATENT DOCUMENTS

| | | | | |
|---|---|---|---|---|
| 8,292,111 | B2 * | 10/2012 | Newberry | B65D 43/0212 220/254.2 |
| 2005/0040168 | A1 * | 2/2005 | Solowiejko | B65D 21/022 220/254.2 |
| 2006/0283752 | A1 * | 12/2006 | Alegre de Miquel | A47K 10/421 206/494 |
| 2007/0138180 | A1 * | 6/2007 | Vovan | B65D 43/021 220/266 |
| 2008/0179326 | A1 * | 7/2008 | Krauth | B65D 83/0805 220/260 |
| 2010/0122985 | A1 * | 5/2010 | Peters | A47K 10/421 220/262 |
| 2010/0193522 | A1 * | 8/2010 | Wisniewski | B65D 55/02 220/324 |
| 2014/0027458 | A1 * | 1/2014 | Liu | B65D 43/164 220/270 |
| 2014/0183196 | A1 * | 7/2014 | Rosenquist | A61B 19/0288 220/288 |
| 2014/0339247 | A1 * | 11/2014 | Gonnert | B65D 47/0814 220/829 |
| 2015/0114984 | A1 * | 4/2015 | Mehdizadeh | A47K 10/421 221/63 |

* cited by examiner

RECLOSABLE LID ASSEMBLY FOR COVERING DISPENSING OPENING OF FLEXIBLE PACKAGING FOR WET WIPES

CROSS REFERENCE TO RELATED APPLICATION

This application claims the benefit of U.S. Provisional Application No. 61/975,211, filed Apr. 4, 2014, which is hereby incorporated by reference.

FIELD OF THE INVENTION

The present invention relates to a reclosable lid assembly for covering dispensing opening of flexible packaging for wet wipes.

BACKGROUND OF THE INVENTION

Reclosable lids for covering dispensing opening of flexible packaging for wet wipes usually must provide an anti-pilfer feature and a moisture retaining feature.

Prior art solutions require the use of a separate pilfer tape adhered to the flexible packaging above the dispensing opening. This pilfer tape must be attached to the flexible packaging during the manufacturing process to ensure that the wet wipes retain their moisture while disposed inside the packaging. The pilfer tape adds to the cost and production time of the packaging. In addition, the pilfer tape is relatively easy to open and close after manufacturing without the end-purchaser realizing that the wipes may have been tampered with and/or compromised in some way. Finally, the pilfer tape can pose a choking hazard to babies when it is removed from the packaging. The present invention provides a solution to the above problems.

SUMMARY OF THE DISCLOSURE

According to the principles of the present invention a reclosable lid assembly is provided. The assembly is intended for covering a dispensing opening of flexible packaging for wet wipes. The assembly includes a rigid base having a first end and second end, wherein the rigid base is adapted to be attached to the flexible packaging and positioned above the dispensing opening. The assembly includes a main lid joined to the first end of the rigid base by a first living hinge. The assembly includes a locking lid secured to the rigid base. The assembly includes a break tab joined to the locking lid by a second living hinge and secured to the locking lid by at least one breakable connector.

In an initial position, the break tab covers part of the main lid to prevent the main lid from being opened by a user.

A functioning position is achieved when the user applies a force to the break tab to break the breakable connector for allowing the break tab to be moved away from the main lid so that the main lid can be freely opened by a user.

DETAILED DESCRIPTION OF THE INVENTION

The drawings show a reclosable lid assembly for covering a dispensing opening of flexible packaging for wet wipes. The reclosable lid assembly of the present invention allows the packaging to have both an anti-pilfer feature and a moisture retaining feature.

FIGS. 1-11 illustrate a first embodiment of the present invention.

Figure 1:
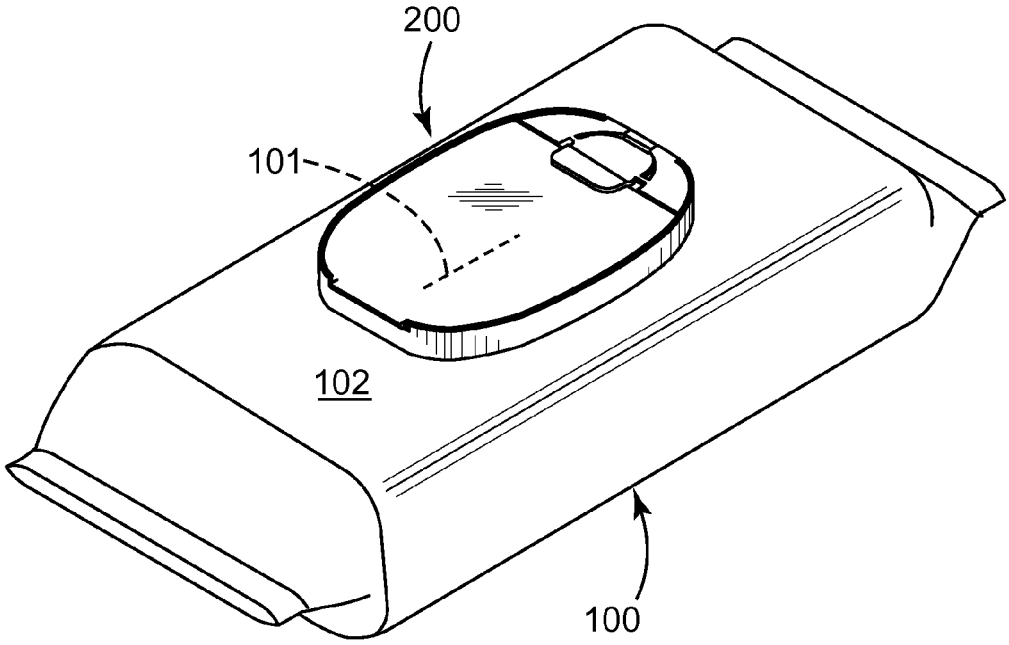
FIG. 1 is a perspective top view of the reclosable lid assembly according to a first embodiment of the present invention, being shown in the initial position and attached to the flexible packaging.

FIG. 1 is a perspective top view of the reclosable lid assembly 200 according to a first embodiment of the present invention, being shown in the initial position and attached to the flexible packaging 100. Namely, the assembly 200 is attached to the top surface 102 of the flexible packaging and is positioned above the dispensing opening 101. The dispensing opening 101 of the packaging can be a slit opening (as shown) or other opening known in the packaging art. Wet or dry wipes (not shown) are disposed inside the packaging 100, for example, wet baby wipes or wet industrial wipes. The assembly can be manufactured in various sizes to accommodate various size packaging 100. In one example, an assembly intended for large (industrial wipes) can have molded dimensions of 8.43×2.75×0.39 inches, with final dimensions when closed of 4.08×2.75×0.38 inches. In another example, an assembly intended for small (consumer wipes) can have molded dimensions of 6.97×2.62×0.39 inches, with final dimensions when closed of 3.33×2.63×0.38 inches.

Figure 2:
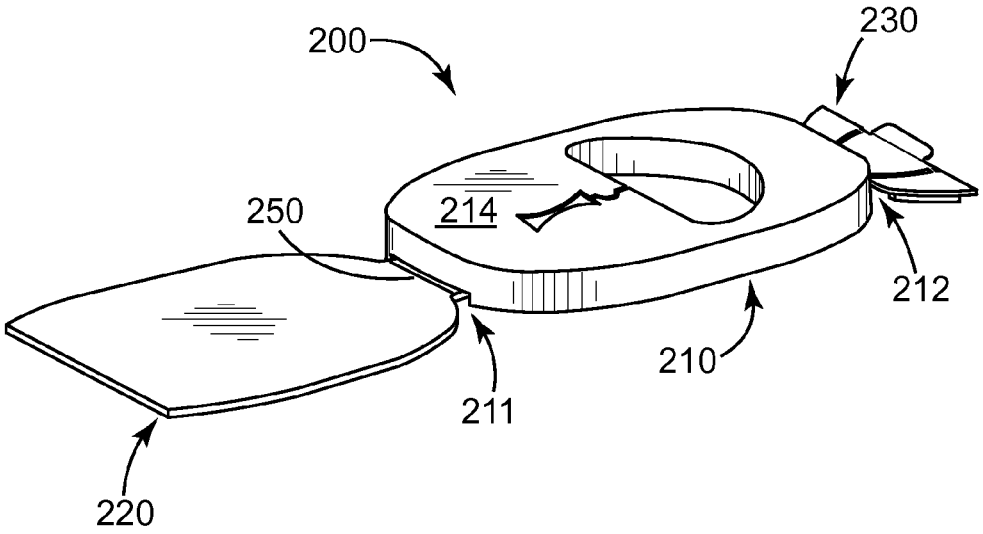
FIG. 2 is a perspective bottom view of the assembly of FIG. 1, after the part has been removed from the mold.

FIG. 2 is a perspective bottom view of the assembly 200 of FIG. 1, after the part has been removed from the mold. The assembly includes three main portions that are joined by two respective living hinges. Namely, the first portion of the assembly includes a rigid base 210 having a first end 211 and a second end 212. In a preferred embodiment, the lower surface 214 of the rigid base 210 is flat so as to rest flush against the top surface 102 of the flexible packaging (see FIG. 1). The rigid base can be glued to the flexible packaging or adhered by other suitable means to provide for a substantially air-tight connection around the perimeter. The second portion of the assembly includes a main lid 220 that is joined to the first end 211 of the rigid base 200 by a first living hinge 250. The main lid 220 can be opened and closed for the duration of use of the product. The third portion of the assembly includes a locking lid 230 that is secured to the rigid base 210 in the manner described below.

Figure 3:
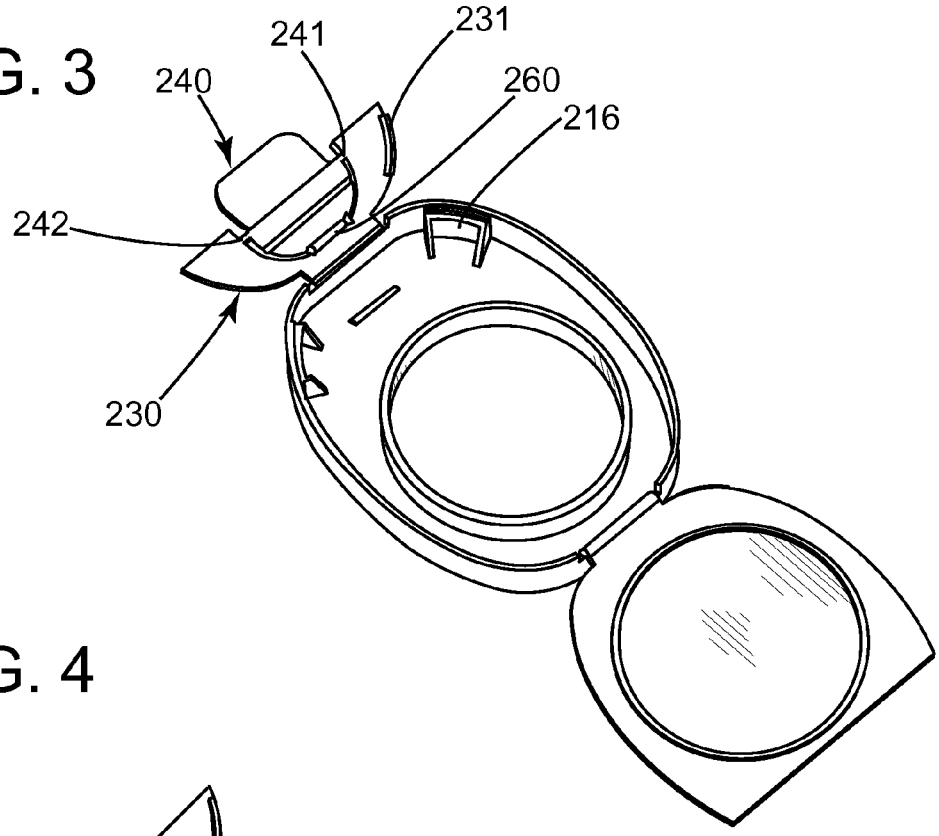
FIG. 3 is a perspective top view of the assembly of FIG. 1, after the part has been removed from the mold.

FIG. 3 is a perspective top view of the assembly of FIG. 1, after it has been removed from the mold. The assembly includes a break tab 240 that is joined to the locking lid 230 by a second living hinge 260 and is secured to the locking lid 230 by at least one breakable connector 241 that is formed as a continuous portion of material joining the adjacent portions together. In a preferred embodiment, the assembly includes two breakable connectors 241 and 242 that are disposed on opposite sides of the break tab 240.

Figure 4:
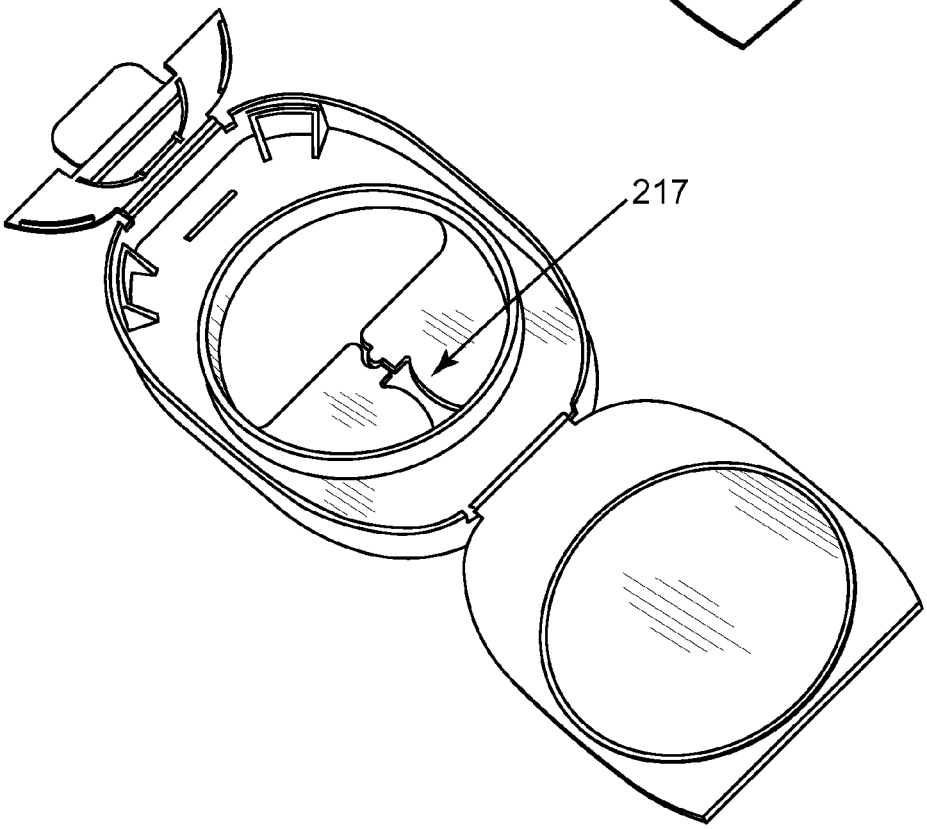
FIG. 4 is a perspective top view of the assembly of FIG. 1, wherein the assembly includes an optional towel guide aperture for the wet wipes.

FIG. 4 is a perspective top view of the assembly of FIG. 1, wherein the assembly includes an optional towel guide aperture 217 joined to the main opening via a channel having a curved path. The wet wipes can be pulled into the towel guide aperture 217 by a user. The towel guide aperture 217 is adapted to align with the dispensing opening 101 (see FIG. 1) to capture and retain the next wipe during retrieval from the packaging and assists the user in easily removing the wipes as one sheet at a time. The towel guide aperture 217 creates a shorter length of towel inside the round well allowing the main lid 220 to close without catching the next towel or wipe. The towel guide aperture can include a bowtie aperture as shown in FIG. 4. The corners of the towel guide aperture can be rounded or squared or any other shape.

Figure 5:
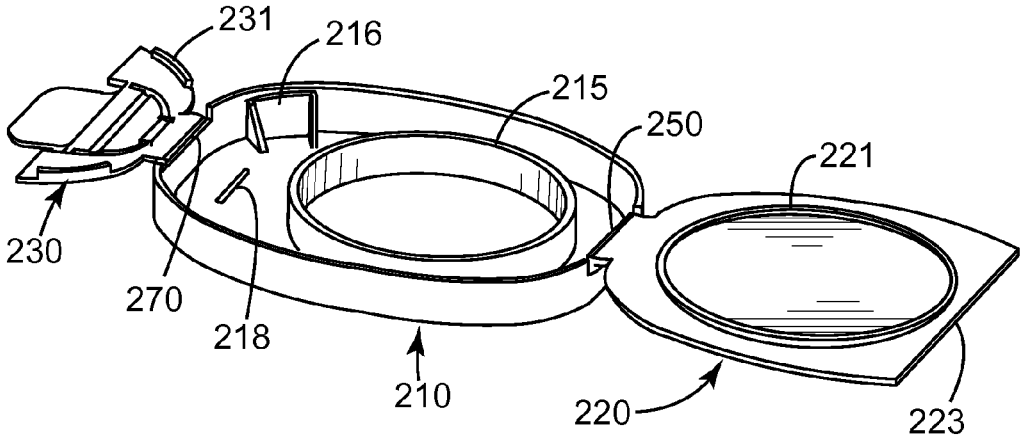
FIG. 5 is a perspective top view of the assembly of FIG. 1, after the part has been removed from the mold.
Figure 6:
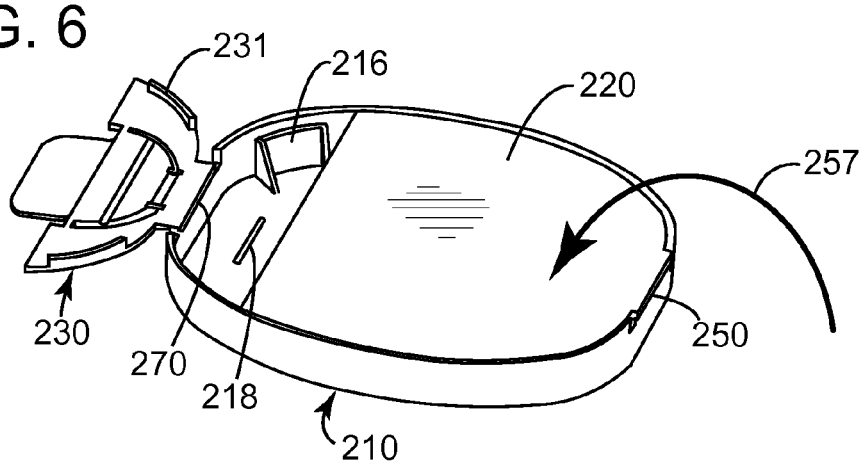
FIG. 6 is a perspective top view of the assembly of FIG. 1, shown with the main lid being closed during final assembly of manufacturing.
Figure 7:
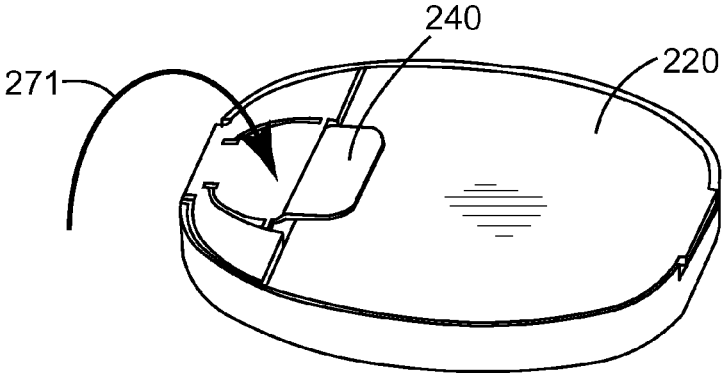
FIG. 7 is a perspective top view of the assembly of FIG. 1, shown with the locking lid being closed during final assembly of manufacturing.

FIGS. 5-7 illustrate the method of assembly of the invention after the part has been removed from the mold. The invention can be manufactured through a plastic injection molding process using polypropylene or other suitable plastic material.

FIGS. 5-6 show the first step of the assembly of the part. The main lid 220 is rotated by a factory worker or robot by rotating the distal end 223 along a first living hinge 250 which joins the rigid base 210. The inner surface of the main lid includes a sealing lip 221 that mates with an updwardly protruding wall 215 of the rigid base to provide a substantially airtight seal above the dispensing opening of the flexible packaging when the main lid is closed. The sealing lip 221 of the main lid keeps moisture in the flexible packaging bag by locking around the upwardly protruding wall 215 of the rigid base. In a preferred embodiment the sealing lip 221 and protruding wall 215 form an interlocking snap fit to permit the tight seal. In a preferred embodiment, the upwardly protruding wall 215 forms a circular opening and the sealing lip 221 forms a ring. In one embodiment, an O-ring or other suitable means can be utilized to enhance the seal between the sealing lip 221 and the protruding wall 215.

FIGS. 6-7 show the next step of step of the assembly of the part. The locking lid 230 is next rotated by a factory worker or robot by rotating along a third living hinge 270 which joins the rigid base 210. The inner surface of the locking lid includes a first engagement member 231 that mates with a locking rib 216 of the rigid base to secure the locking lid 230 to the rigid base 210. In a preferred embodiment the first engagement member 231 and locking rib 216 form an interlocking snap fit to permit the secure connection. The snap fit can include any combination of male and female interlocking members or other known attachments. Preferably, the material of the part includes a memory retaining quality so that the attachment is secure after the connection is made. In a preferred embodiment, once the locking lid 230 has been secured to the rigid base 210, the connection cannot be released without significant force that would likely cause obvious and visible damage to the part to alert the end user that the product has been tampered with. This is because the snap fit or other locking arrangement is inaccessible when the locking lid 230 is secured to the rigid base 210.

As shown in FIG. 7, after the locking lid 230 has been secured to the rigid base 210, an initial position of the invention is achieved, whereby the break tab 240, which is connected to the locking lid 230, covers the distal end 223 of the main lid 220 to prevent the main lid from being opened by a user.

Figure 8:
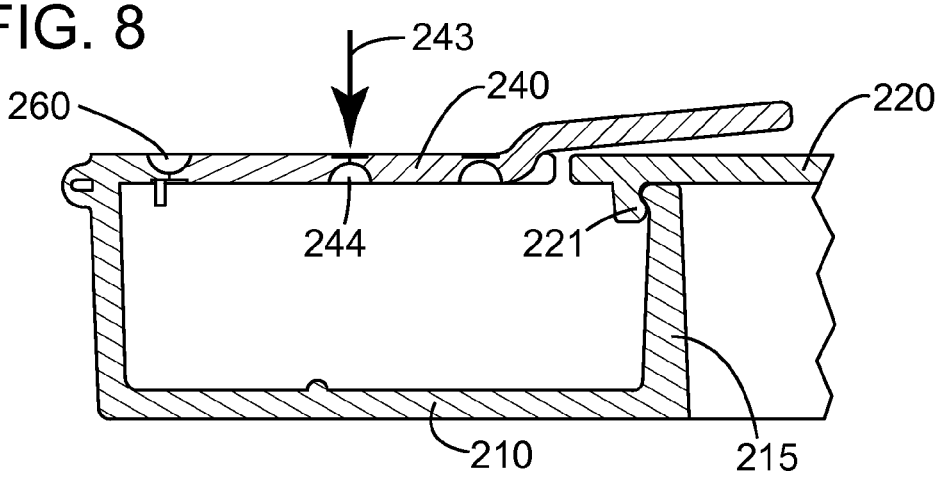
FIG. 8 is a cross-sectional side view of the assembly of FIG. 1.
Figure 9:
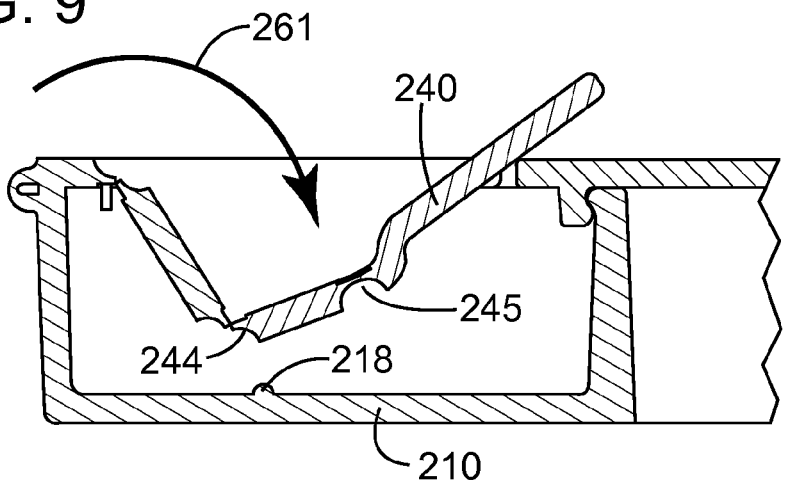
FIG. 9 is a cross-sectional side view of the assembly of FIG. 1, wherein the user presses down on the break tab to break the breakable connector and rotate the break tab away from the main lid.
Figure 10:
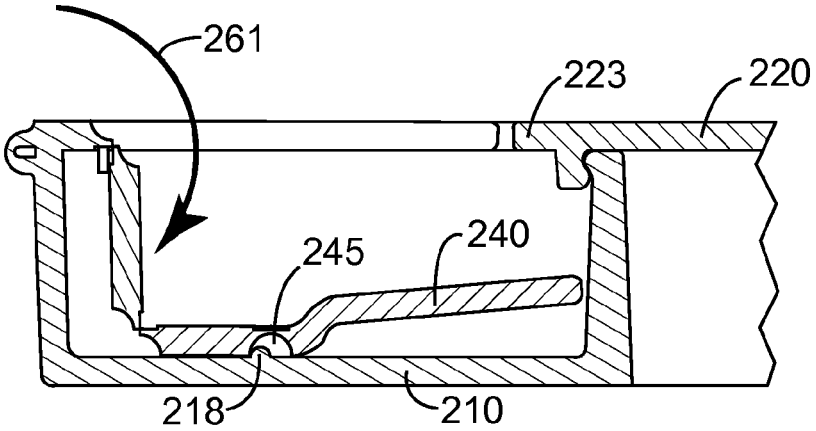
FIG. 10 is a cross-sectional side view of the assembly of FIG. 1, wherein the break tab has been pressed down into a locked down position, now allowing the main lid to be freely opened by a user.

FIGS. 8-10 illustrate the consumer operation by the end user before using the product for the first time.

In the first step shown in FIGS. 8-9, the user presses down on the break tab with a finger applying force as shown by arrow 243. This force will cause the breakable connectors 241 and 242 (see FIG. 3) to snap, allowing the rotation (shown by arrow 261) of the break tab 240 down and away from the distal end of the main lid 220. The break tab includes a longitudinal groove 244, wherein as the user presses down on the break tab 240 to rotate away from the main lid 220, the break tab folds along the longitudinal groove 244 to allow a portion to rest flush against the rigid base 210. In one embodiment, an optional parking rib 218 protrudes upwardly from the rigid base 210 and captures a parking groove 245 that is cut in the break tab 240, as shown in the last step of FIG. 10. In the position shown in FIG. 10, the user can now open the main lid freely by pulling up on the distal end 223 of the main lid 220.

Figure 11:
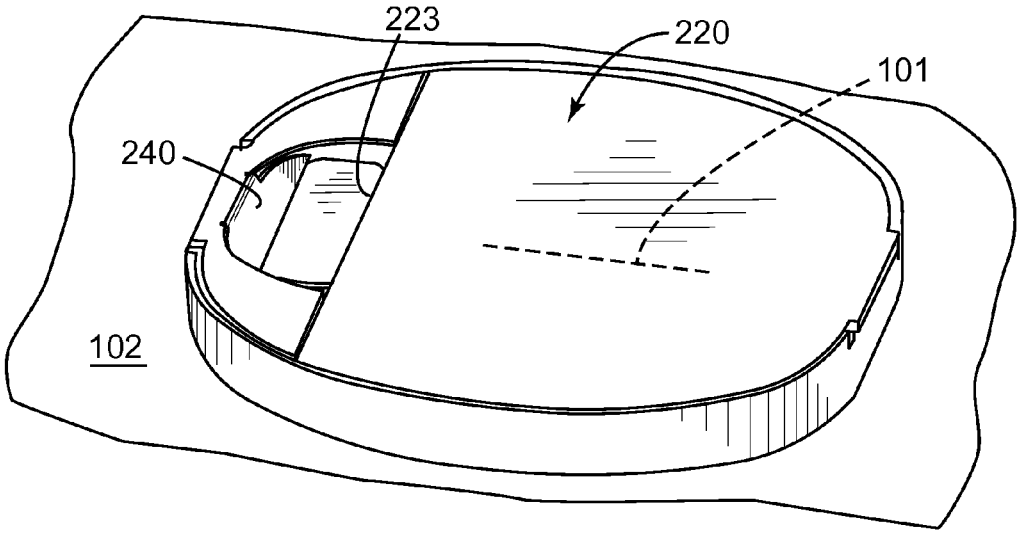
FIG. 11 is a perspective top view of the assembly of FIG. 1, shown with the break tab in the locked down position.

FIG. 11 is a perspective top view of the assembly of FIG. 1, shown with the break tab 240 in the locked down position of FIG. 10. The user can now freely open the main lid 220 by inserting a finger into the cavity created in the part and pulling up on the distal end 223 of the main lid with enough force to break the substantially airtight seal formed between the main lid and the rigid base, as described above.

FIGS. 12-22 illustrate a second embodiment of the present invention, which is similar to the first embodiment and these similar features do not require repeating. The distinctions of this second embodiment as compared with the first embodiment will now be described with reference to the figures.

Figure 12:
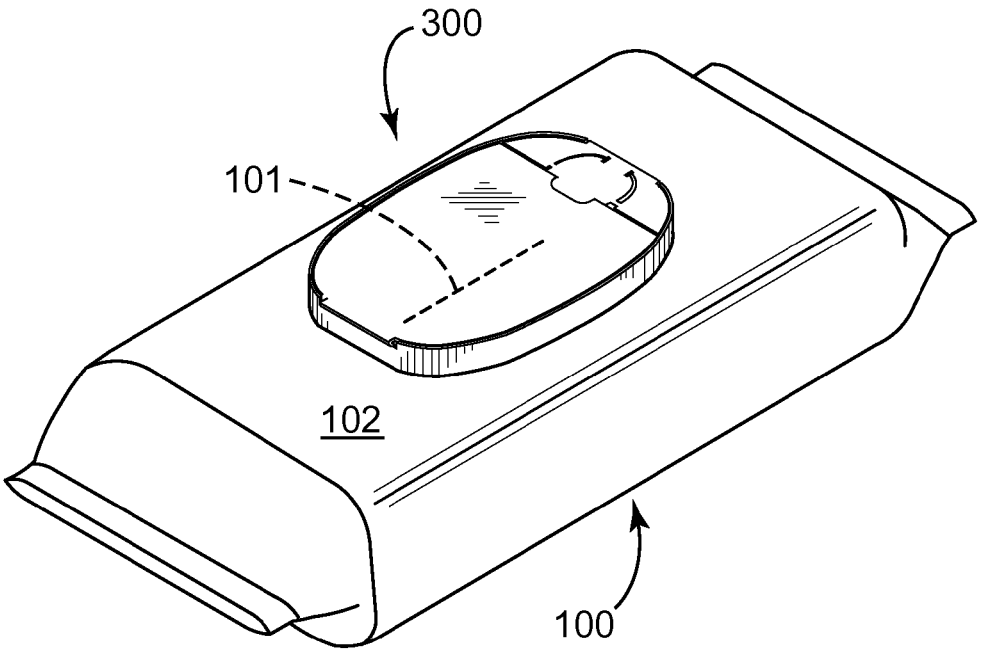
FIG. 12 is a perspective top view of the reclosable lid assembly according to a second embodiment of the present invention, being shown in the initial position and attached to the flexible packaging.

FIG. 12 is a perspective top view of the reclosable lid assembly 300 according to a second embodiment of the present invention, being shown in the initial position and attached to the flexible packaging 100. In this embodiment, the top of the lid assembly forms a continuous flat surface which provides a larger flat surface for printing manufacturer's art work or other information for the product.

Figure 13:
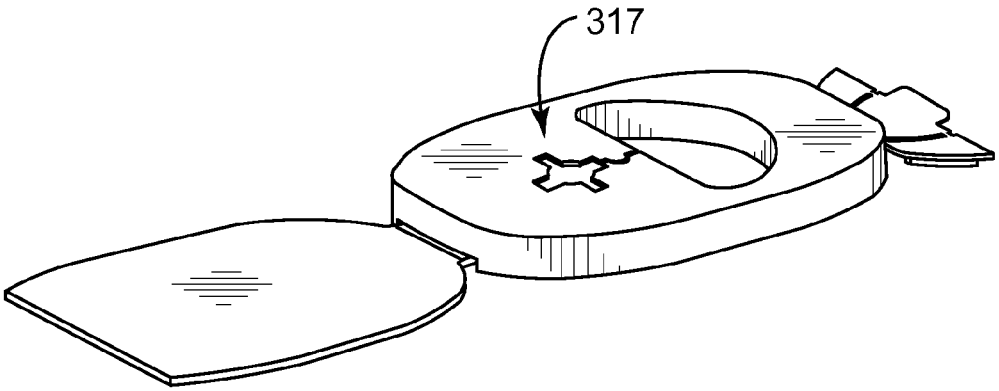
FIG. 13 is a perspective bottom view of the assembly of FIG. 12, after the part has been removed from the mold.

FIG. 13 is a perspective bottom view of the assembly of FIG. 12, after the part has been removed from the mold. In this embodiment the towel guide aperture 317 includes a cross shape pattern having a central circular opening, allowing addition wipe or towel material to be captured during use. In one embodiment, the cross pattern is 0.600 inches long by 0.600 inches wide, having four protruding arms each having a width of 0.070 inches, and including a central circular opening having a diameter of 0.187 inches.

Figure 14:
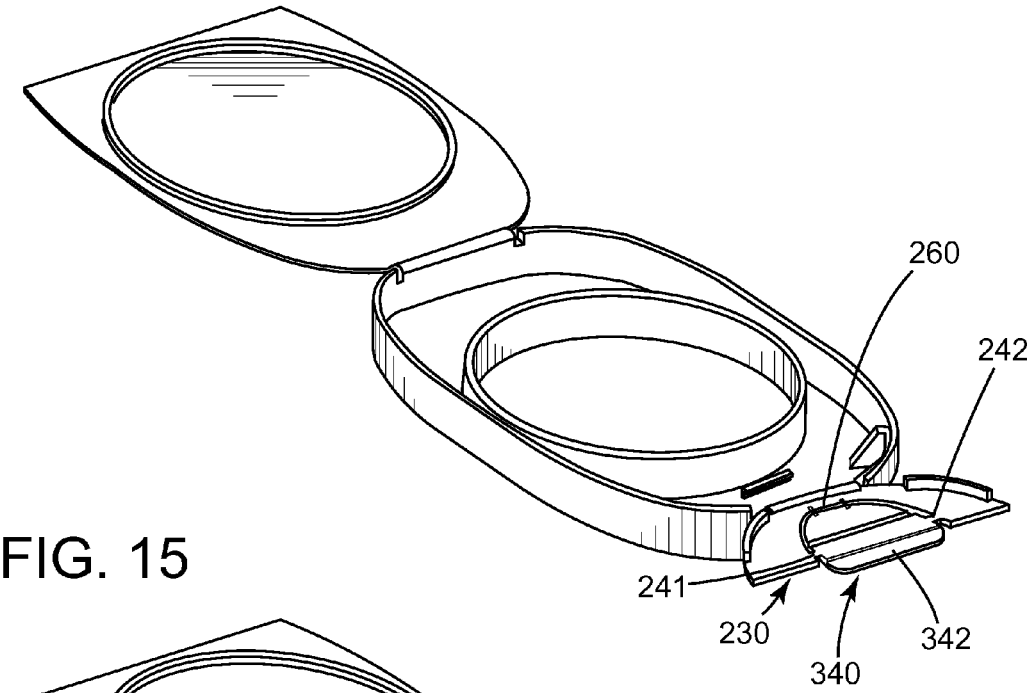
FIG. 14 is a perspective top view of the assembly of FIG. 12, after the part has been removed from the mold.

FIG. 14 is a perspective top view of the assembly of FIG. 12, after the part has been removed from the mold. The assembly includes a break tab 340 that is joined to the locking lid 230 by a second living hinge 260 and is secured to the locking lid 230 by at least one breakable connector 241 that is formed as a continuous portion of material joining the adjacent portions together. In a preferred embodiment, the assembly includes two breakable connectors 241 and 242 that are disposed on opposite sides of the break tab 340.

Figure 15:
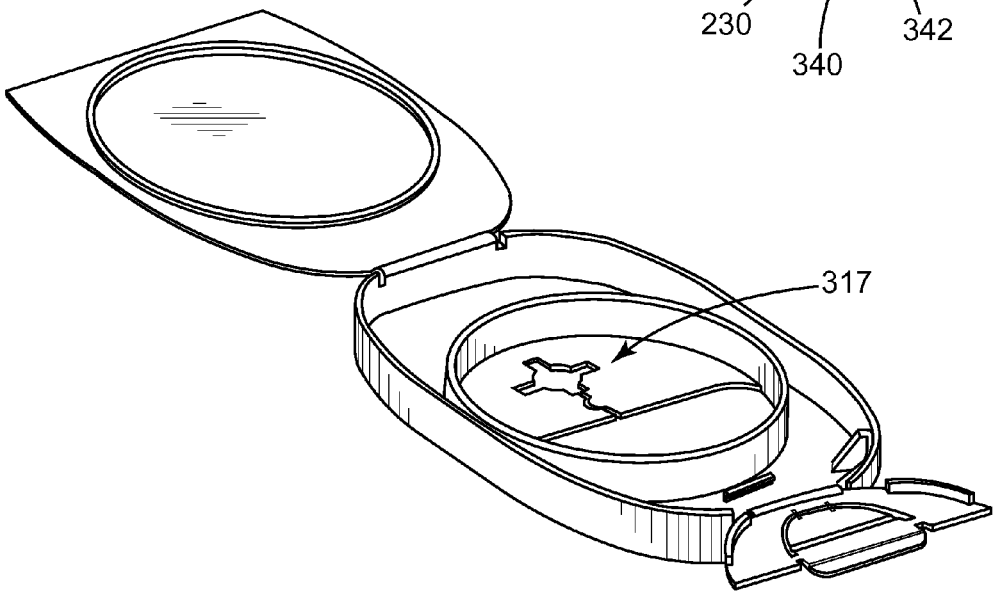
FIG. 15 is a perspective top view of the assembly of FIG. 12, wherein the assembly includes an optional towel guide aperture for the wet wipes.

FIG. 15 is a perspective top view of the assembly of FIG. 12, wherein the assembly includes an optional towel guide aperture 317 for the wet wipes. The towel guide aperture 317 is adapted to align with the dispensing opening 101 (see FIG. 12) as described above. The corners of the towel guide aperture can be rounded or squared or any other shape.

Figure 16:
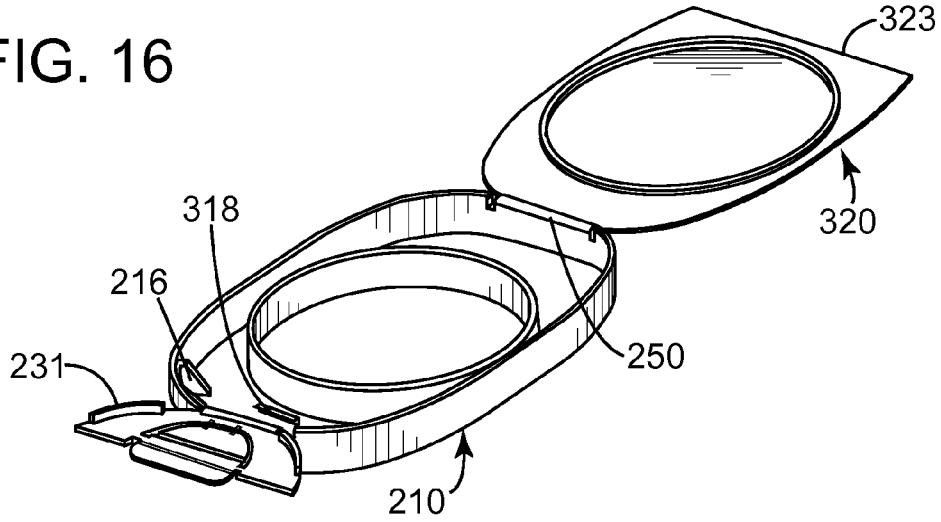
FIG. 16 is a perspective top view of the assembly of FIG. 12, after the part has been removed from the mold.
Figure 17:
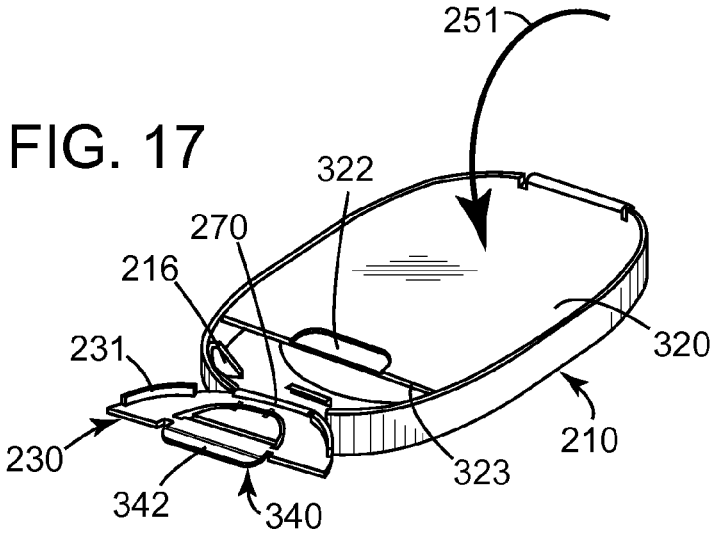
FIG. 17 is a perspective top view of the assembly of FIG. 12, shown with the main lid being closed during final assembly of manufacturing.
Figure 18:
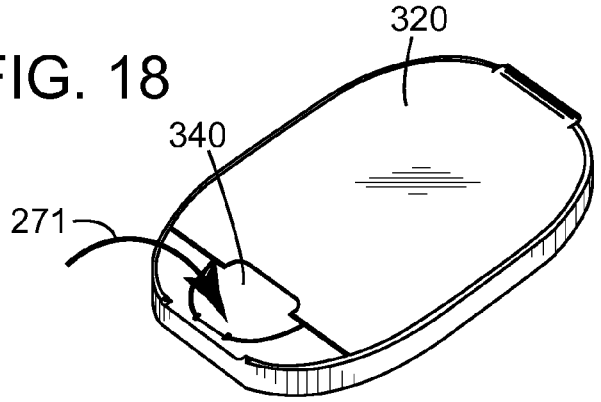
FIG. 18 is a perspective top view of the assembly of FIG. 12, shown with the locking lid being closed during final assembly of manufacturing.

FIGS. 16-18 illustrate the method of assembly of the second embodiment of the invention after the part has been removed from the mold.

FIGS. 16-17 show the first step of the assembly of the part. The main lid 320 is rotated by a factory worker or robot by rotating the distal end 323 along a first living hinge 250 which joins the sealing lip 221 of the rigid base to form a tight seal as described above with reference to the first embodiment.

FIGS. 17-18 show the next step of step of the assembly of the part. The locking lid 230 is next rotated by a factory worker or robot by rotating along a third living hinge 270 which joins the rigid base 210. The inner surface of the locking lid includes a first engagement member 231 that mates with a locking rib 216 of the rigid base to secure the locking lid 230 to the rigid base 210 as described above with reference to the first embodiment.

As shown in FIG. 18, after the locking lid 230 has been secured to the rigid base 210, an initial position of the invention is achieved, whereby the break tab 340, which is connected to the locking lid 230, covers the distal end 323 of the main lid 220 to prevent the main lid from being opened. In particular a shoulder 342 of the break tab interlocks with a corresponding shoulder 322 of the main lid, as described below and shown in FIGS. 17 and 19.

Figure 19:
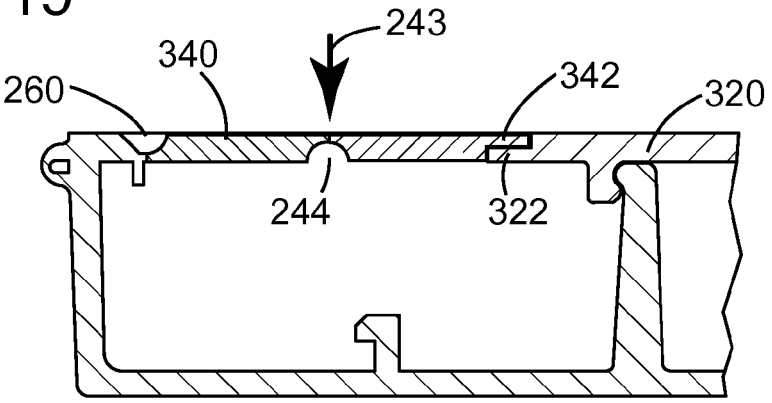
FIG. 19 is a cross-sectional side view of the assembly of FIG. 12.
Figure 20:
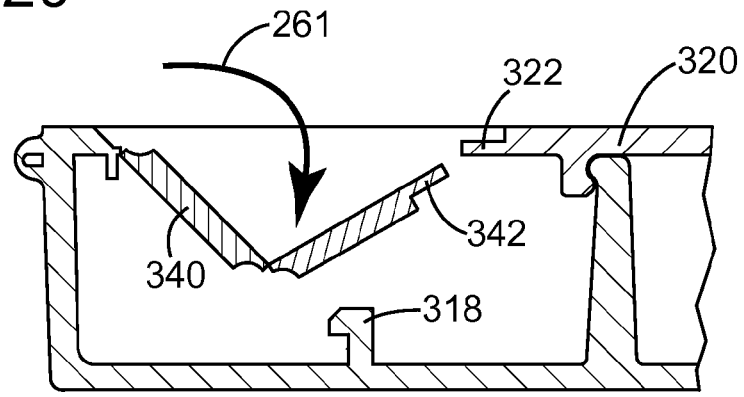
FIG. 20 is a cross-sectional side view of the assembly of FIG. 12, wherein the user presses down on the break tab to break the breakable connector and rotate the break tab away from the main lid.
Figure 21:
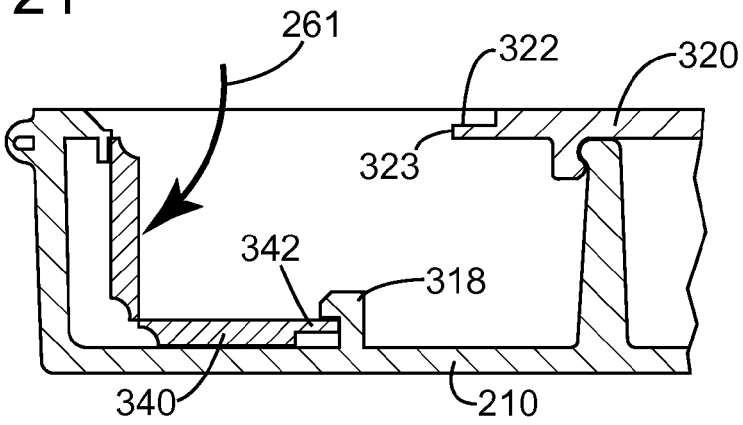
FIG. 21 is a cross-sectional side view of the assembly of FIG. 12, wherein the break tab has been pressed down into a locked down position, now allowing the main lid to be freely opened by a user.

FIGS. 19-21 illustrate the consumer operation of the second embodiment by the end user before using the product for the first time. As shown in FIG. 19, the break tab 340 includes a shoulder 342 having a laterally extending top surface and the main lid 320 includes a corresponding shoulder 322 having a laterally extending bottom surface, wherein the shoulders are connected to form flush top and bottom surfaces. In this position, the top surface of the main lid 320 joins the top surface of the break tab 340 to form a continuous flat surface.

In the first step shown in FIGS. 19-20, the user presses down on the break tab with a finger applying force as shown by arrow 243. This force will cause the breakable connectors 241 and 242 (see FIG. 14) to snap, allowing the rotation (shown by arrow 261) of the break tab 340 down and away from the distal end of the main lid 320. The break tab includes a longitudinal groove 244, wherein as the user presses down on the break tab 340 to rotate away from the main lid 320, the break tab folds along the longitudinal groove 244 to allow a portion to rest flush against the rigid base 210. In one embodiment, an optional locking stop rib 318 protrudes upwardly from the rigid base 210 and captures the distal end of the break tab 340, as shown in the last step of FIG. 21. In the position shown in FIG. 21, the user can now open the main lid freely by pulling up on the distal end 323 of the main lid 320.

Figure 22:
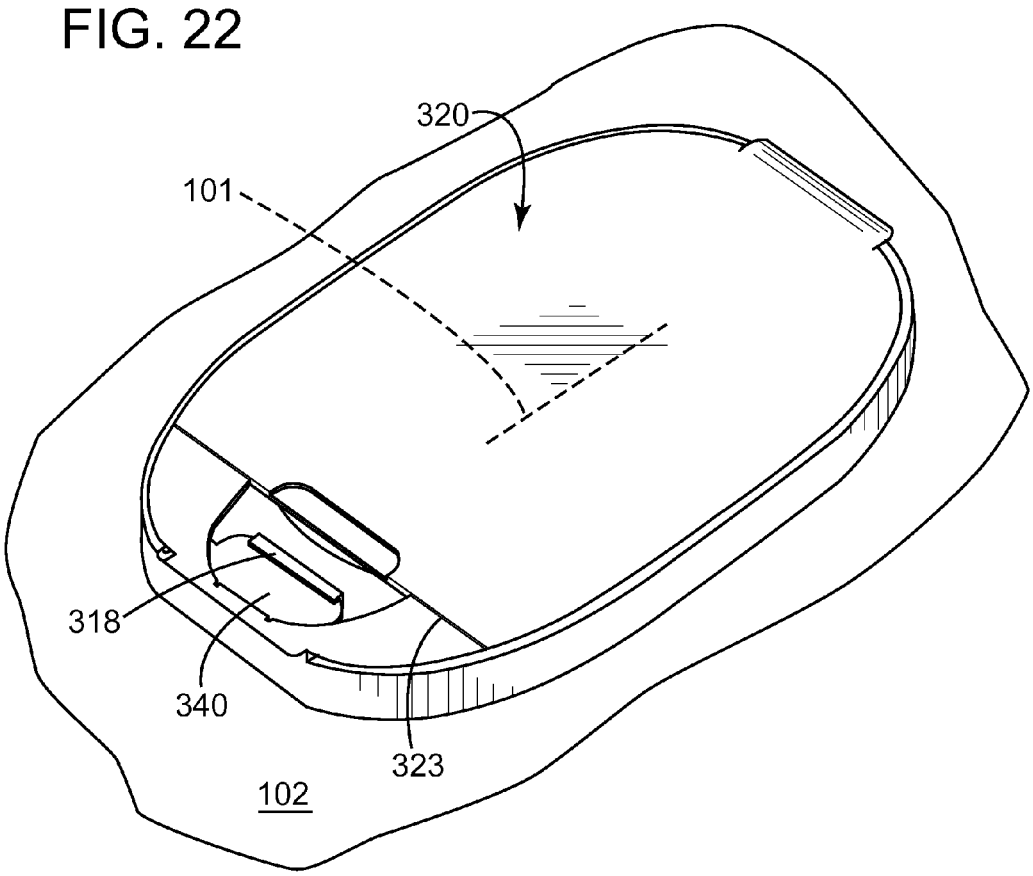
FIG. 22 is a perspective top view of the assembly of FIG. 12, shown with the break tab in the locked down position.

FIG. 22 is a perspective top view of the assembly of FIG. 12, shown with the break tab 340 in the locked down position of FIG. 21. The user can now freely open the main lid 320 by inserting a finger into the cavity created in the part and pulling up on the distal end 323 of the main lid with enough force to break the seal described above.

CONCLUSION

It will thus be seen from the preceding that the problems set forth above are solved in a particularly effective, simple, and inexpensive way, with a considerable advantage to the user, as well as the manufacturer. The reclosable lid assembly of the present invention is easy to open and close, while including a clearly visible anti-pilfer feature that is opened by the end user prior to initial use. Because the present invention provides a substantially airtight seal over the dispensing opening of the flexible packaging, the prior art adhesive film that is typically used to cover the dispensing opening can be eliminated. The elimination of the adhesive film results in cost and time savings during manufacturing and assembly. The elimination of the adhesive film also eliminates the choking hazard that is found when the adhesive film is removed from the package by a user.

It is to be understood that the invention as presented can be used with any type of packaging for holding any type of tissues, wipes, towels, or the like, including the single stack and the interlocking designs. The invention can be used on flexible packaging or rigid packaging.

The above disclosure is intended to be illustrative and not exhaustive. This description will suggest many modifications, variations, and alternatives may be made by ordinary skill in this art without departing from the scope of the invention. Those familiar with the art may recognize other equivalents to the specific embodiments described herein. Accordingly, the scope of the invention is not limited to the foregoing specification.

I claim:

1. A reclosable lid assembly for covering a dispensing opening of packaging for wet wipes, the assembly comprising:

a rigid base having a first end and second end, wherein the rigid base is adapted to be attached to the packaging and positioned above the dispensing opening;

a main lid rotatably joined to the first end of the rigid base by a first living hinge and positioned above the dispensing opening; and a break tab secured to the assembly by at least one breakable connector, wherein in an initial position, the break tab covers part of the main lid for preventing the main lid from being opened by a user, wherein a functioning position is achieved when the user applies a force on the break tab to break the breakable connector for allowing the break tab to be moved away from the main lid so that the main lid can be freely opened by a user;

wherein the main lid has a distal end and wherein the main lid is dimensioned and configured so that the distal end is spaced away from the second end of the rigid base when closed allowing space for the user to grasp the distal end of the main lid before opening wherein the rigid base forms an internal cavity separate from the dispensing opening, and wherein the break tab is rotated towards and housed inside the internal cavity when in the functioning position.

2. The assembly of claim 1, further comprising:

a locking lid secured to the rigid base; and wherein the break tab is joined to the locking lid by a second living hinge and secured to the locking lid by at least one breakable connector.

3. The assembly of claim 2, wherein the locking lid is joined to the second end of the rigid base by a third living hinge.

4. The assembly of claim 2, wherein the locking lid includes a first engagement member and the rigid base includes a second engagement member that mates with the first engagement member to secure the locking lid to the rigid base.

5. The assembly of claim 1, wherein the rigid base includes a flat lower surface adapted to be adhered to the top surface of the packaging.

6. The assembly of claim 1, wherein the rigid base includes an upwardly protruding wall and the inside of the main lid includes a sealing lip that mates with the upwardly protruding wall to provide a substantially airtight seal above the dispensing opening of packaging when the main lid is closed.

7. The assembly of claim 6, wherein the upwardly protruding wall forms a circular opening and the sealing lip forms a ring.

8. The assembly of claim 1, wherein the break tab includes a shoulder having a laterally extending top surface and the main lid includes a corresponding shoulder having a laterally extending bottom surface;

wherein in the initial position the shoulders are connected.

9. The assembly of claim 8, wherein in the initial position, the top surface of the main lid joins the top surface of the break tab to form a continuous flat surface.

10. The assembly of claim 1, wherein the break tab includes a longitudinal groove;

wherein when the user presses down on the break tab to break the breakable connector and rotate the break tab away from the main lid, the break tab folds along the longitudinal groove to allow the distal end section of the break tab to rest flush against the rigid base.

11. The assembly of claim 2, wherein the rigid base includes an upwardly protruding locking rib;

wherein when the user presses down on the break tab to break the breakable connector and rotate the break tab away from the main lid, the distal end of the break tab is secured against the locking rib.

12. The assembly of claim 2, wherein the rigid base further comprises a towel guide aperture for the wet wipes.

13. A reclosable lid assembly for covering a dispensing opening of packaging for wet wipes, the assembly comprising:

a rigid base having a first end and second end, wherein the rigid base is adapted to be attached to the packaging and positioned above the dispensing opening;

a main lid rotatably joined to the first end of the rigid base by a first living hinge and positioned above the dispensing opening; and a break tab secured to the assembly by at least one breakable connector, wherein in an initial position, the break tab covers part of the main lid for preventing the main lid from being opened by a user, wherein a functioning position is achieved when the user applies a force on the break tab to break the breakable connector for allowing the break tab to be moved away from the main lid so that the main lid can be freely opened by a user;

wherein the rigid base includes a flat lower surface adapted to be adhered to the top surface of the packaging;

wherein the flat lower surface of the rigid base is devoid of any grooves wherein the rigid base forms an internal cavity separate from the dispensing opening, and wherein the break tab is rotated towards and housed inside the internal cavity when in the functioning position.

14. The assembly of claim 13, wherein the rigid base further comprises a towel guide aperture for the wet wipes.

15. A reclosable lid assembly for covering a dispensing opening of packaging for wet wipes, the assembly comprising:

a rigid base having a first end and second end, wherein the rigid base is adapted to be attached to the packaging and positioned above the dispensing opening;

a main lid rotatably joined to the first end of the rigid base by a first living hinge and positioned above the dispensing opening;

a locking lid secured to the rigid base; and a break tab joined to the locking lid by a second living hinge and secured to the locking lid by at least one breakable connector, wherein in an initial position, the break tab covers part of the main lid for preventing the main lid from being opened by a user, wherein a functioning position is achieved when the user applies a force on the break tab to break the breakable connector for allowing the break tab to be moved away from the main lid so that the main lid can be freely opened by a user wherein the rigid base forms an internal cavity separate from the dispensing opening, and wherein the break tab is rotated towards and housed inside the internal cavity when in the functioning position.

16. The assembly of claim 15, wherein the rigid base further comprises a towel guide aperture for the wet wipes.

17. A reclosable lid assembly for covering a dispensing opening of packaging for wet wipes, the assembly comprising:

a rigid base having a first end and second end, wherein the rigid base is adapted to be attached to the packaging and positioned above the dispensing opening;

a main lid rotatably joined to the first end of the rigid base by a first living hinge and positioned above the dispensing opening;

a locking lid immovably secured to the rigid base; and a break tab secured to the locking lid by at least one breakable connector, wherein in an initial position, the break tab covers part of the main lid for preventing the main lid from being opened by a user, wherein a functioning position is achieved when the user applies a force on the break tab to break the breakable connector for allowing the break tab to be moved away from the main lid so that the main lid can be freely opened by a user while the locking lid is immovably secured to the rigid base wherein the rigid base forms an internal cavity separate from the dispensing opening, and wherein the break tab is rotated towards and housed inside the internal cavity when in the functioning position.

18. The assembly of claim 17, wherein the rigid base further comprises a towel guide aperture for the wet wipes.

* * * * *